United States Patent [19]

Meuresch et al.

[11] 4,015,757

[45] Apr. 5, 1977

[54] RAPID CHARGING VALVE FOR A PRESSURIZED DISPENSER

[75] Inventors: Herbert Meuresch, Wiesbaden; Steven Padar, Kelkheim; Franz Zimmerhackel, Hattersheim, all of Germany

[73] Assignee: Precision Valve Corporation, Yonkers, N.Y.

[22] Filed: Jan. 27, 1976

[21] Appl. No.: 652,730

[30] Foreign Application Priority Data

Jan. 29, 1975 Germany ..... 2503626

[52] U.S. Cl. ..... 222/402.16; 222/402.24

[51] Int. Cl.[2] ..... B65D 83/00

[58] Field of Search ..... 222/402.24, 402.16, 222/402.17, 402.18, 402.19, 402.2, 402.21, 402.22, 402.23, 402.24, 402.25

[56] References Cited

UNITED STATES PATENTS 3,556,357 1/1971 Killara ..... 222/402.22

3,845,887 11/1974 Meuresch et al. ..... 222/402.16

*Primary Examiner*—Stanley H. Tollberg

*Attorney, Agent, or Firm*—Davis, Hoxie, Faithfull & Hapgood

[57] ABSTRACT

A valve for a pressurized dispenser which includes, within a mounting cup, a valve housing and an annular gasket clamped between the cup and the housing for sealing a discharge passage of a movable valve stem, and which incorporates a clearance space in the cup around the outer marginal portion of the gasket to accommodate the marginal portion when the gasket is stretched during the filling of the dispenser to provide a flow path to the outside of the housing, and which has spacers spaced apart around the periphery of the gasket to define the distance between the cup and the housing within which the gasket is clamped, and between which the stretched gasket extends.

7 Claims, 3 Drawing Figures

RAPID CHARGING VALVE FOR A PRESSURIZED DISPENSER

Figure 1:
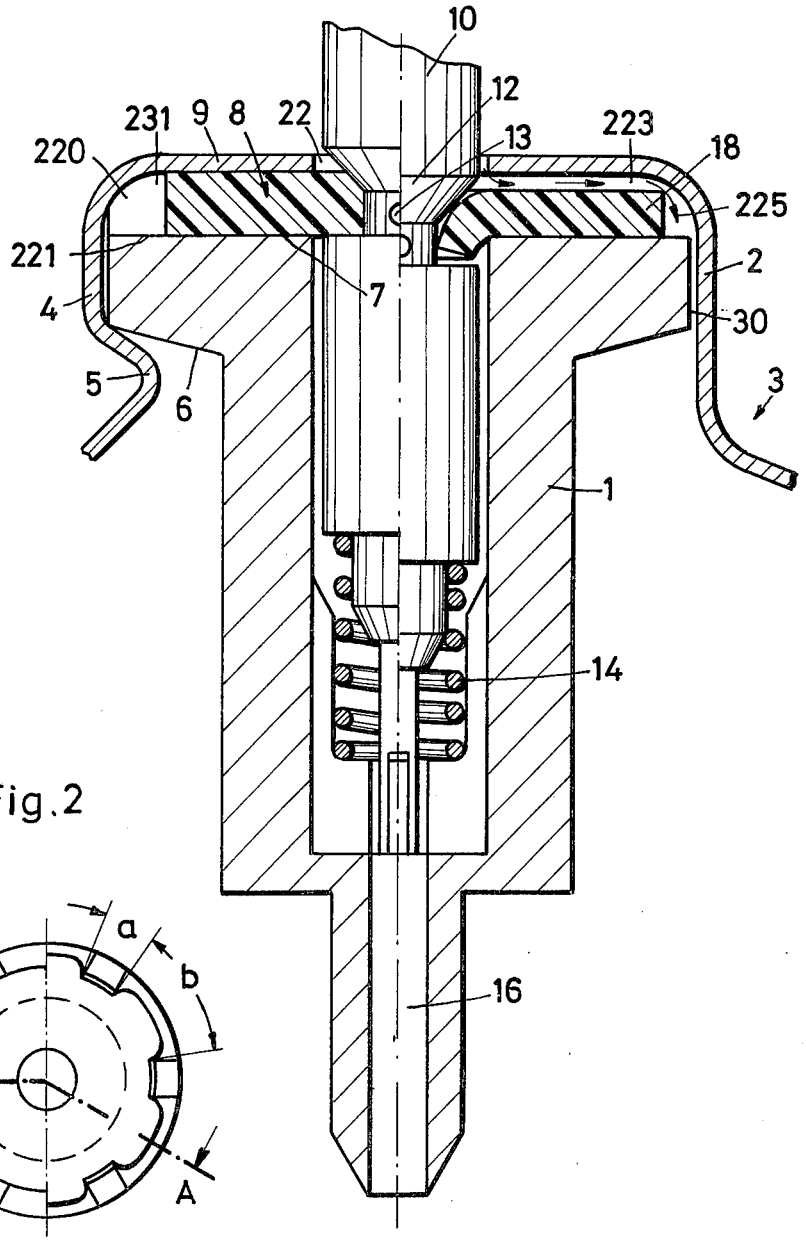

The invention relates to a valve for pressurized aerosol dispensers, the valve having an annular gasket provided with a hole for receiving a valve stem and pressed by a clamping edge on the valve housing against the end wall of the pedestal of a valve mounting cup immovably holding the valve housing, and wherein at least one filling aperture is provided in the end wall around the valve stem hole, filling passages extend near the circumferential wall of the valve mounting cup, and the gasket is adapted to be forced away from the end wall of the valve mounting cup under the influence of the pressure of propellant gas during charging.

U.S. Pat. No. 3,845,887 to Meuresch et al shows a gasket with a polygonal periphery wherein the circumferential sections having the shortest radial distance from the center extend outwardly beyond the clamping edge by an amount such that, when the portion of the gasket under the filling aperture is bent downwardly under the influence of the filling pressure, the portion of the gasket clamped by the housing rim will be stretched away from the end wall and accordingly will provide additional filling passages outside the valve housing. In this way the filling speed may be substantially increased.

U.S. Pat. Nos. 3,838,799 to Meuresch et al, 2,890,817 to Rheinstrom, and 2,937,791 to Micallef show valves in which the gasket extends beyond the clamping edge above an annular space defined partly by sloping shoulders of the housing and partly by the circumferential wall of the valve mounting cup. In the end wall of the valve mounting cup there are provided additional filling apertures radially outward of the clamped region of the gasket. The gasket margin below these filling apertures will be directly influenced by the filling pressure and will be bent downwardly, thereby opening additional filling passages outside the valve housing. In these constructions, however, the margin of the gasket is sealed against the filling apertures only by the internal pressures of the container.

Other known structures for providing for filling outside the valve housing over the gasket by displacing the gasket axially are shown in Treharne, Jr. U.S. Pat. Nos. 3,441,177, Ferry, Jr. et al; 3,158,297, and Briechle 3,158,298. Ferry Jr. and Micallef also show structures in which the valve housing is axially displaced by filling pressure to unclamp the gasket. British patent specification 1,362,885 shows a structure in which the gasket is axially raised to allow gas ducted through the valve stem to pass the clamped region and flow outside the valve housing.

The present invention provides a dispenser valve which during filling permits the greater proportion of the fluid to flow outside a valve housing thereby permiting faster and more reliable filling than filling exclusively through the valve, while providing a tight seal after filling.

In accordance with the present invention, this goal is achieved by providing a clearance space radially outward of the valve housing rim which clamps the gasket, which clearance space accommodates marginal portions of the gasket as the gasket is radially stretched under the influence of filling pressure.

In this construction the clearance space ensures that the gasket margin may be freely expanded. Accordingly, the gasket is more easily compressed in thickness in the clamped region to provide a passage for filling fluid to pass by the clamped region. The gasket returns to its initial position and thickness when filling pressure is terminated the elastic restoring forces of the gasket providing a tight seal at the clamped portion. Consequently, the filling pressure will compress the gasket is the clamped region to open a filling passage throughout the circumference of the clamped region. The fluid flowing outwardly over the gasket also tends to radially stretch or expand the gasket thereby assisting in thinning the gasket in the clamped region. Since the filling aperture is radially interior of the clamped region, a tight seal after filling is ensured.

It is of particular advantage that the degree of clamping of the gasket between the clamping rim of the housing and the inner surface of the end wall be uniform among units. According to another aspect of the invention, the distance between the clamping rim of the housing and the end wall is determined by spacer means which extend between the valve housing and the end wall. By placing these spacer means radially outward of the gasket perimeter, great area for filling flow is provided. Since the tolerances of the spacer means and the thickness of the gasket can be kept small during manufacture, the degree of compression of the gasket is uniform among dispenser units. As a result of the close control over the degree of gasket compression afforded by the spacer means, the degree of compression of the gasket can be kept low to make compression and thinning of the gasket easier during filling to result in a larger area passageway for faster filling. Preferably the spacer means should establish an axial distance between the clamping rim of the housing and the adjacent surface of the end wall between 85 and 95% of the initial thickness of the gasket with no compression. This leads to the desired small degree of compression of the gasket and correspondingly higher filling rate. Preferably the spacer means are in the form of circumferentially separated projections or posts extending from the valve housing to the end wall. Between the projections slots may be formed in the valve housing perimeter to provide generous areas for filling fluid flow. It is desirable to provide no more than six, preferably four spacer means uniformly circumferentially distributed about the circumference. In this way a sufficiently large clearance space may be achieved. The circumferential separation of the spacer means should be at least double the circumferential extent of the spacer means and may be even more than double.

Portions of the gasket peripheral edge in the normal condition prior or subsequent to filling should extend to contact the inner surface of the surrounding circumferential separated spacer means adjacent the gasket periphery. This assists in maintaining the gasket centered with respect to the valve axis.

The invention will now be explained with reference to the accompanying drawing representing a preferred embodiment by way of example.

Figure 2:
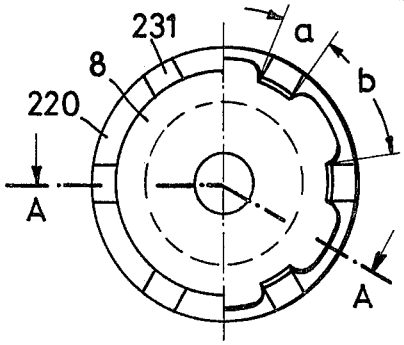
Figure 3:
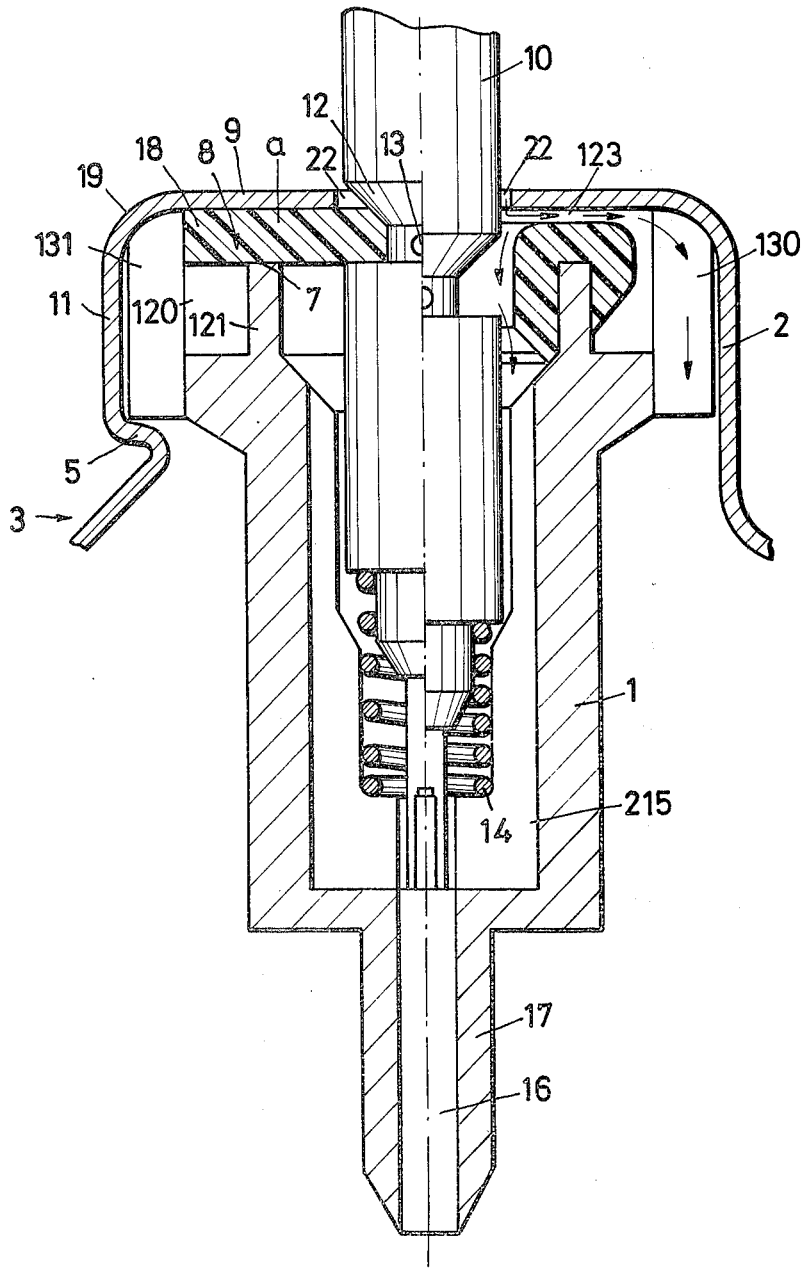

In the drawings:

FIG. 1 shows a cross section along line A—A of FIG. 2 of a valve in accordance with the invention, the left half of the figure showing the valve in its normal closed position and the right half of the figure showing the valve in its position during filling, FIG. 2 is a plan view of the housing the gasket expanded radially during filling in the right half of the figure, and FIG. 3 is a view in cross section of another embodiment of the invention, the left half of the figure showing the valve in the normal closed position and the right half of the figure showing the valve in its position during filling.

Referring now to FIG. 1, a valve housing 1 is fixedly held in a valve mounting cup pedestal 3 having a circumferential wall 4 and an end wall 9. The valve mounting cup constitutes a closure member which is sealed to the mouth of the container. The housing 1 is affixed in the pedestal by circumferentially spaced crimps 5 engaging the underside of a flange 6 of the valve housing. A clamping rim 7 of the housing presses axially against a gasket 8, clamping the gasket against the end wall 9 of the pedestal of the valve mounting cup.

A moveable valve body having a hollow valve stem 10 passes through a central aperture in the gasket 8. The inner edge of the gasket aperture engages a neck portion 12 to block valve orifice 13 communicating with the hollow interior of the valve stem 10 upon which a button having a spray nozzle is usually placed. The valve body is biased upwardly by a spring 14 located in the interior chamber of the valve housing 1. A restricted area passage 16 extends to a nipple 17 for receiving a eduction or dip tube. When the valve stem 10 is depressed the gasket 8 is deflected out of blocking engagement with valve orifice 13 to establish a passage for product from the container through the hollow valve stem 10. Between the circumferential wall 4 of the pedestal and the periphery of the valve housing 1 is a gap 30 which communicates the container interior with a clearance space 220. A central aperture 22 in the end wall 9 is larger in diameter than valve stem 10 to provide a filling aperture outside the valve stem 10. A series of radially separated projections 221 extend axially from the housing 1 to engage the end wall 9 of the pedestal portion 8 the valve mounting cup 3. The gasket 8 is kept centered by the inner faces of the projections 221.

During filling fluid flows into the container not only through the valve stem and open valve port 13 but also through filling aperture 22. Filling pressures of 40 to 120, bars, for example, compress the gasket 8 in the clamped region to provide a flow path over the gasket. Accordingly, the material of the gasket will, because of this compression, be displaced outwardly. A compresson of 10% in thickness will lead to an increase in diameter of the same percentage. This radial expansion of the gasket is accommodated by the clearance spaces 220 between the projections such that the gasket assumes the shape shown in the right half of FIG. 2. The clearance space 220 is dimensioned such that after radial expansion a gap 225 remains between the peripheral edge of the gasket and the circumferential wall 4. The filling fluid flows, as indicated by the arrows on the right of FIG. 1, through a relatively open path into the container. As soon as filling is terminated, the gasket 8 returns, due to its elasticity, into the initial position shown on the left side of FIG. 1. The internal pressure of the now filled container further assists in restoring the gasket to its sealed condition.

During the filling the gasket 8 will occupy the position represented in the right side of FIG. 1. The inner marginal portion interior of the clamping rim 7 will be bent downwardly by filling pressure to establish a flow path interior of the housing 1. The outer marginal portion 18 is accommodated in the clearance space 220 to stretch considerably the upper surface of the gasket, and accordingly, the gasket is substantially thinned in the clamped region, thereby providing a large area gap 223 between the gasket and the end wall 9. Also the gap 225 between the sealing disc perimeter and the wall 4 will be of substantial area. In addition to the filling flow path outside the housing there exists a filling flow path from aperture 22 interior of the housing and exterior of the stem as well as the flow path through the valve stem 10 and opened orifice 13. This configuration provides extremely rapid and reliable filling and resealing.

Spacer means 231 in the form of ribs or posts circumferentially spaced about the valve housing outside the periphery of the gasket extend to the end wall 9 of the pedestal to establish with certainty the distance between the clamping rim 7 and end wall 9, which distance determines the degree of gasket compression. The spacer means 231 are circumferentially separated by spaces 220 which are open to the interior of the container. Filling flow is shown by arrows on the right side of FIG. 1 to pass over the thinned clamped portion of the gasket through gap 223 and thence through spaces 220 between spacer means 231. The periphery of the gasket extends to the inner faces of the spacer means 231 with the intervening portions of the periphery spaced away from the surrounding wall. Thus, the gasket has portions which extend to contact the surrounding structure and other portions which do not. Consequently, the gasket may have a circular periphery with no risk of blockage of the filling path.

The embodiment of FIG. 3 has spacer means 131 in the form of ribs or posts circumferentially spaced about the valve housing outside the periphery of the gasket which extend to the end wall 9 of the pedestal to establish with certainty the distance between the clamping rim 7 and end wall 9, which distance determines the degree of gasket compression. The spacer means 131 are circumferentially separated by spaces 130 which are open to the interior of the container. Filling flow is shown by arrows on the right side of FIG. 3 to pass over the thinned clamped portion of the gasket through gap 123 and thence through spaces 130 between spacer means 131. The periphery of the gasket extends to the inner faces of the spacer means 131 with the intervening portions of the periphery spaced away from the surrounding wall. Thus, the gasket has portions which extend to contact the surrounding structure and other portions which do not. Consequently, the gasket for the embodiment of FIG. 3 may have a circular periphery with no risk of blockage of the filling path.

A clearance space 120 is provided below the gasket margin 18 having an abutment surface 124 at a right angle with respect to the clamping rim 7. A central aperture 22 in the end wall is larger in diameter than valve stem 10 to provide a filling aperture outside valve stem 10 and radially interior of the clamped region *a* of the gasket.

During filling, fluid flows not only through the valve stem and open valve part 13, but also through filling aperture 22. Filling pressures of 40 to 120 bars, for example, compress the gasket 8 in clamped region *a* to provide a flow path over the gasket. Accordingly, the material of the gasket will, because of this compression, be displaced outwardly. A compression of 10% in thickness will lead to an increase in diameter of the same percentage. This radial expansion of the gasket is accommodated by the clearance space 120. At the same time the gasket 8 is bent downwardly and is pressed against abutment surface 121. This downward bending of the gasket is furthered by the high pressure and high velocity of fluid flow over the gasket. This clearance space 120 is dimensioned such that after bending and radial expansion a flow path 130 exists in the space between spacers 131. Consequently, the filling fluid flows, as indicated by arrows on the right side of FIG. 3, through a relatively open path into the container. As soon as filling is terminated, the gasket 8 returns, due to its elasticity, into the initial position shown on the left side of FIG. 3. The internal pressure of the now filled container further assists in restoring the gasket to its sealed condition.

The valve of the present invention is particularly useful for dispensers charged with $CO_2$ or other compressed gas. Valves not having a filling flow path outside the valve housing must be charged through the housing and pressures and filling rates must be kept relatively low to avoid bursting the housing. By proportioning flow inside and outside the housing, much higher pressures and flow rates can be employed. High pressure, high flow rate filling using a conventional housing with a circular gasket results in very few successfully filled dispensers. Use of the hexagonal gasket and conventional housing shown in Meuresch et al U.S. Pat. No. 3,845,887 produces a sharp improvement, but still results in some failures. The present invention can be successfully charged with high pressure, high flow rates with virtually no failures.

What is claimed is:

1. In a valve for a pressurized dispenser, said valve having a mounting cup, a valve housing immovable relative thereto and an annular gasket for sealing a discharge passage, said mounting cup having a pedestal portion comprising an end wall and a circumferential wall and a filling aperture in the end wall radially outward of the discharge passage and only inward of the clamping rim, a region of the gasket being clamped between a rim of said housing and said end wall the improvement which comprises clearance space means adjacent the outer marginal portion of the gasket to accommodate the marginal portion so that the marginal portion may radially stretch during filling to provide a flow passage along the adjacent wall surfaces over the gasket, past the clamped region and around the peripheral edge of the gasket, and a plurality of spacer means extending between said housing and said end wall located radially outwardly of the gasket perimeter to define the axial distance between said clamping rim and said end wall.

2. The improvement of claim 1 wherein said spacer means are circumferentially separated to provide the clearance space to allow the gasket to radially extend between said spacer means during filling.

3. The improvement of claim 1 wherein there are no more than 6 spacer means.

4. The improvement of claim 2 wherein the circumferential separation between the spacer means is least twice the circumferential extent of each of the spacer means adjacent the gasket.

5. The improvement of claim 1 wherein the spacer means are projections which extend axially from the valve housing.

6. The improvement of claim 1 wherein the axial distance defined by the spacer means is at least 85% of the thickness of the gasket when uncompressed.

7. The improvement of claim 1 wherein the clearance space is below the marginal portion of the gasket to accommodate the marginal portion so that the marginal portion may radially stretch and deflect during filling.

* * * * *

UNITED STATES PATENT AND TRADEMARK OFFICE

CERTIFICATE OF CORRECTION

PATENT NO. : 4,015,757

DATED : April 5, 1977

INVENTOR(S) : Herbert Meuresch et al

It is certified that error appears in the above-identified patent and that said Letters Patent are hereby corrected as shown below:

Title page, first column, last line; the inventor's name should be changed from "Killara" to --Graham--.

Col. 2, line 7; "is" should be --in--.

Col. 2, line 66; --showing-- should be inserted after "housing".

Signed and Sealed this

*second* Day of *August 1977*

[SEAL]

*Attest:*

RUTH C. MASON
*Attesting Officer*

C. MARSHALL DANN
*Commissioner of Patents and Trademarks*